US005925216A

United States Patent [19]

Bergqvist et al.

[11] Patent Number: 5,925,216

[45] Date of Patent: Jul. 20, 1999

[54] METHOD OF CONTINUOUS PULPING IN A DIGESTER WITH HIGH BLACK LIQUOR USAGE IN THE IMPREGNATION STAGE

[75] Inventors: Anders Bergqvist; Johan Engström, both of Karlstad, Sweden

[73] Assignee: Kvaerner Pulping AB, Karlstad, Sweden

[21] Appl. No.: 08/854,948

[22] Filed: Aug. 5, 1997

Related U.S. Application Data

[63] Continuation of application No. PCT/SE95/01333, Nov. 10, 1995.

[30] Foreign Application Priority Data

Nov. 15, 1994 [SE] Sweden ..... 9403978

[51] Int. Cl.[6] ..... D21C 3/24; D21C 7/14

[52] U.S. Cl. ..... 162/37; 162/39; 162/41; 162/251

[58] Field of Search ..... 162/17, 19, 37, 162/39, 42, 45, 238, 243, 245, 250, 251

[56] References Cited

U.S. PATENT DOCUMENTS

| | | | |
|---|---|---|---|
| 3,303,088 | 2/1967 | Gessner | 162/19 |
| 3,427,218 | 2/1969 | Richter et al. | 162/19 |
| 5,080,755 | 1/1992 | Backlund | 162/19 |
| 5,658,428 | 8/1997 | Oulie | 162/42 |

FOREIGN PATENT DOCUMENTS

| | | | |
|---|---|---|---|
| 0 477 059 A2 | 9/1991 | European Pat. Off. | D21C 3/02 |
| 0 527 294 A1 | 4/1992 | European Pat. Off. | D21C 3/24 |
| WO 95/18261 | 7/1995 | WIPO . | |

*Primary Examiner*—Dean T. Nguyen
*Attorney, Agent, or Firm*—Farkas & Manelli, PLL; Jeffrey S. Melcher

[57] ABSTRACT

The present invention provides a method for continuously cooking kraft pulp in a digester having the steps of:

feeding chips into an inlet of a digester;

supplying black liquor to an impregnation zone of the digester in an amount such that the black liquor makes up greater than 40% by volume of the total volume of liquid present in the impregnation zone;

extracting liquor from a screen girdle downstream of where the black liquor is added to the digester, in the direction the wood chips flow through the digester, in an amount greater than 50% by volume of the total volume of liquor present at the location of the screen girdle;

maintaining a liquor:wood ratio in the impregnation zone of greater than 3:1; and discharging cooked pulp from the digester.

17 Claims, 1 Drawing Sheet

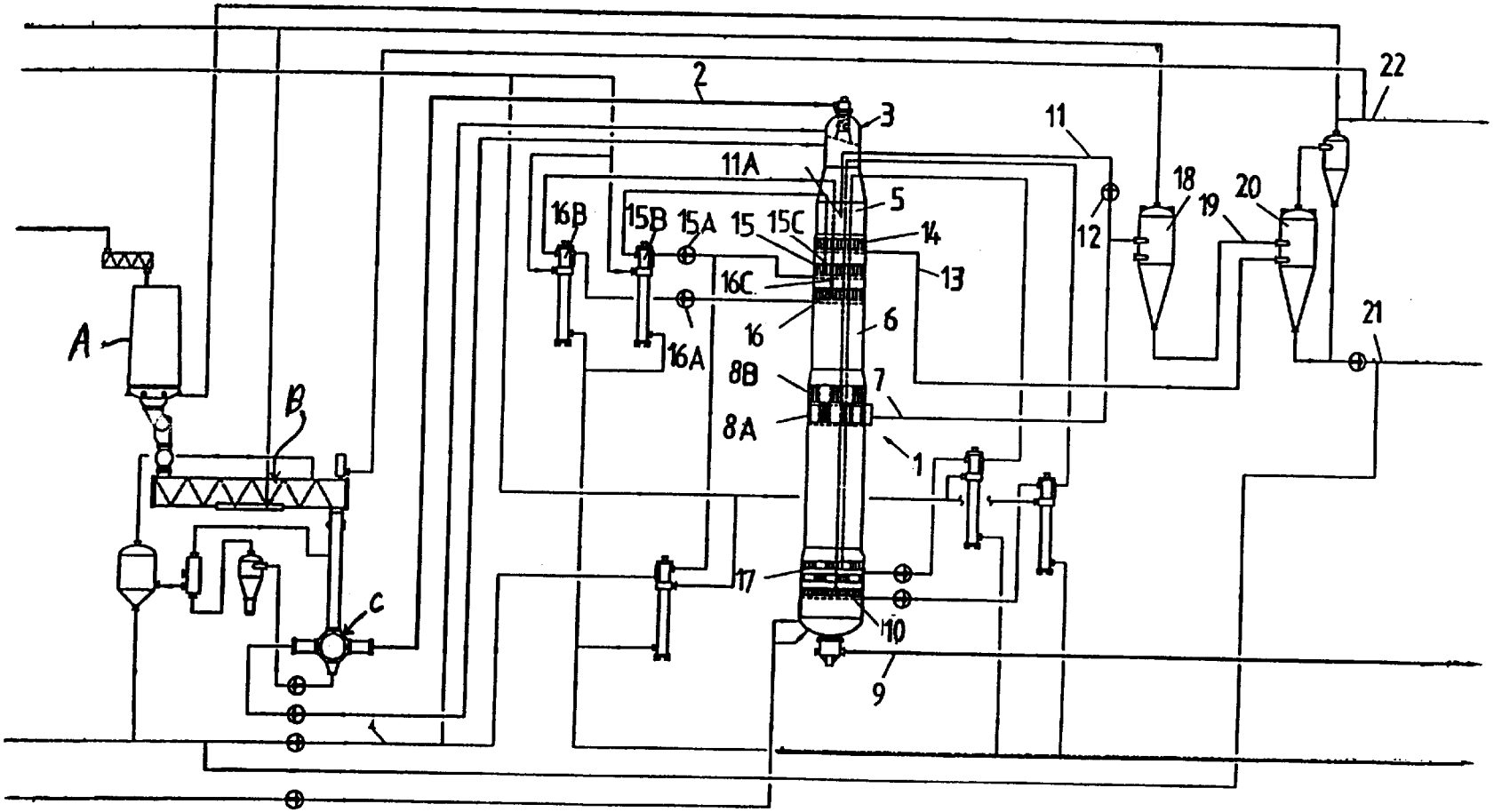
22
21
20
19
18
12
11
13
14
5
3
6
7
1
10
9
15C
15
16C
16
8B
8A
17
11A
2
15A
16A
15B
16B
C
B
A

METHOD OF CONTINUOUS PULPING IN A DIGESTER WITH HIGH BLACK LIQUOR USAGE IN THE IMPREGNATION STAGE

This application is a continuation application of international patent application No. PCT/SE95/01333, filed on Nov. 10, 1995, and claims priority Swedish patent application No. 9403978-1 filed on Nov. 15, 1994, the complete disclosures of which are incorporated herein by reference.

TECHNICAL FIELD

The present invention provides a novel method for continuously cooking cellulose-containing fiber material in a digester. The present invention also provides a novel digester.

BACKGROUND OF THE INVENTION

In conventional Kraft digesters, black liquor is used only in a limited amount, for example, in amounts substantially less than 50% of the total liquid content in the impregnation zone of the digester. The remainder of the externally added liquid usually consists of white liquor. It has now been found that this large addition of white liquor at such an early stage in the cooking process may have an adverse effect on the tear resistance of the fully cooked fibers. Thus, there is a need for a method of digesting pulp which utilizes substantially less amounts of white liquor.

U.S. Pat. No. 3,303,088 (Gessner) discloses a method for continuously cooking cellulose-containing fiber material in a single-vessel system in which:

(1) chips are fed in at a first end of the digester, (2) white liquor is added at a position at the first end, (3) the chips are impregnated in a concurrent impregnation zone, (4) the chips are cooked in a cooking zone downstream of the impregnation zone, (5) hot black liquor is extracted from at least one screen section, (6) black liquor is added to the impregnation zone, and (7) cooked pulp is discharged at the other end of the digester.

This patent also discloses that the extracted liquor from the first screen section, which is arranged downstream of the position of the addition of the black liquor, is returned to the digester by first being conveyed to a container in which white liquor and the extracted impregnation and cooking liquids are mixed. Due to this recirculation, a high content of volatile sulphur and terpene compounds in the impregnation and cooking liquid can build up. Furthermore, the method disclosed in Gessner does not permit sufficiently rapid heating of the cooking liquid to achieve optimal process conditions. It is also evident that the method of Gessner does not include process parameters which are necessary to achieve optimal conditions, such as, the correct liquor-to-wood ratio for obtaining the desire movement of the chip column in the digester.

SUMMARY OF THE INVENTION

An objective of the present invention is to provide an improved method for continuously cooking fiber containing cellulose material which solves the problems associated with using a large amount of white liquor.

Another objective of the present invention is to provide a novel digester suitable for practicing the method.

Surprisingly, the above objectives and other objectives can be obtained by a method for continuously cooking kraft pulp in a digester comprising the steps of:

feeding chips into an inlet of a digester;

supplying black liquor to an impregnation zone of the digester in an amount such that the black liquor makes up greater than 40% by volume of the total volume of liquid present in said impregnation zone;

extracting liquor from a screen girdle downstream of where said black liquor is added to the digester, in the direction the wood chips flow through the digester, in an amount greater than 50% by volume of the total volume of liquor present at the location of the screen girdle;

maintaining a liquor:wood ratio in the impregnation zone of greater than 3:1; and discharging cooked pulp from the digester.

The present invention also provides a novel digester for continuously cooking kraft pulp. The digester comprises:

an interior chamber defined by a walled structure;

a chip inlet to the interior chamber for supplying chips to the interior chamber;

an impregnation zone in the interior chamber which is connected to the chip inlet, for impregnating the chips;

at least one screen girdle connected to the impregnation zone for extracting liquor from the impregnation zone, the screen girdle being constructed and arranged to extract an amount of liquor exceeding 50% by volume of the total volume of liquor present at the location of the screen girdle;

a cooking zone in the interior chamber for cooking the impregnated chips;

a black liquor recirculation loop constructed and arranged for recirculating the extracted black liquor to the impregnation zone such that black liquor present in the impregnation zone exceeds 40% by volume of the total volume of liquid present in the impregnation zone, the black liquor recirculation loop comprising an extraction screen in the interior chamber, which is connected to the cooking zone, for extracting black liquor from the cooking zone, and means for supplying the extracted black liquor to a location in the impregnation zone such that there is a dwell time of at least 20 minutes for the chips to move from the location the extracted black liquor is supplied to the impregnation zone to the extraction screen; and at least one cooking liquor recirculation loop comprising a digester screen downstream of the impregnation zone and upstream of the cooking zone for extracting cooking liquor from the digester, a heater connected to the disgester screen for heating cooking liquor extracted by the digester screen, and means for supplying the heated cooking liquor to the digester at a location downstream of said impregnation zone and within 5 meters upstream of the digester screen.

BRIEF DESCRIPTION OF THE DRAWING

The drawing illustrates an embodiment of the digester and method according to the present invention.

DETAILED DESCRIPTION OF PREFERRED EMBODIMENTS

In the method according to the present invention, black liquor is added to an impregnation zone of a digester such that the amount of black liquor present in the impregnation zone is greater than 40% by volume based on the total volume of liquid present in the impregnation zone, in combination with maintaining a liquor:wood ratio of in the impregnation zone exceeding 3:1.

Preferably, the amount of black liquor present in the impregnation zone is greater than 50%, and more preferably greater than 60%, based on the total volume of liquid present in the impregnation zone.

Preferably, the liquor:wood ratio in the impregnation zone is maintained at a value exceeding 3.5:1, and more preferably is equal to or greater than 4:1.

Liquor extracted from the first screen girdle, which is arranged downstream of the position of addition of the black liquor, is largely removed from the digester. For example, the liquor is removed to an extent in excess of 50%, preferably in excess of 70%, and more preferably in excess of 90%, based on the total volume of liquor present at the first screen girdle.

A further aspect of the present invention is that at least one cooking circulation loop is arranged downstream of the first extraction screen, as a result of which a predetermined heating of the recirculated cooking liquid is obtained, and preferably also a predetermined addition of white liquor, so that optimal preconditions for the cooking can be achieved.

Another aspect according to the invention is to ensure that the distance between the lower edge of the screen girdle and the upper edge of the next screen girdle, included in a cooking circulation, in the direction of the feeding of the chips, is less than 5 meters, preferably less than 3 meters, and most preferably less than 1.5 meters, so that it is possible to quickly establish optimal conditions for the cooking.

The present invention will now be explained with reference to the attached drawing. The drawing is a diagrammatic representation of a preferred flow plan for continuous cooking of fiber material in accordance with the present invention.

The drawing illustrates a chip bin, shown at A, a horizontal steaming vessel, shown at B, and a digester, shown at 1. The broken-up fiber material, which preferably comprises wood chips, is fed from the chip bin A through the steaming vessel B to a high-pressure feeder C. The high-pressure feeder C forces the chips through line 2 up to the digester top, shown at 3. An example is shown in Swedish patent no. SE-B-468053. At the digester top 3, there is a screen for separating off a selected quantity of the liquid with which the chips are transported up to the top 3. This liquid can be returned and recirculated via the high-pressure feeder.

The preferred embodiment according to the present invention shown in the drawing includes the use of a hydraulic digester. In contrast to a steam/liquor phase digester, the hydraulic digester is filled hydraulically with liquid and therefore uses a downward feeding screw in the top screen for discharging the chips. After passing through the screw, the chips move slowly downward in the chip column. The chip column has a liquid:wood ratio which is approximately 2.0:1 to 4.5:1, preferably between 3:1 and 4:1.

The temperature in the upper part of the digester, shown at 3, is usually approximately 110 to 120° C., but can sometimes be up towards 135° C. In this upper part, the liquid moves in concurrent in relation to the chip column passing through the digester. After some time, the chips have moved with the chip column down to a level at which a first central pipe, shown at 11, opens out, shown at 11A. The central pipe 11 is connected to a circulation loop, shown at 8A, 7, 12 and 11. This circulation loop extracts hot black liquor from the extraction screen section shown at 8A and 8B, some of which is fed via the line 7 to a first flash cyclone, shown at 18, and the remainder of which is fed with the aid of pump 12 onwards to the central pipe 11. Hot black liquor is therefore supplied in concurrent with the chip column. The black liquor has a temperature of approximately 155 to 165° C. and is supplied in such an amount that the liquor:wood ratio preferably increases by at least ½ a unit, preferably by 1 unit, and in some cases by as much as 1½ units.

According to a most preferred embodiment of the present invention, a sufficiently large addition of hot black liquor is made to obtain a liquor:wood ratio of between 4:1 to 5:1. At 4:1, the liquid comprises just under one part white liquor, one part wood liquor, and just over two parts black liquor.

The temperature which is obtained in this case in the impregnation zone 5 is approximately 120 to 140° C. At a certain distance from the pipe mouth, shown at 11A, of the central pipe 11, viewed in the direction of the chip flow, there is a first extraction screen girdle, shown at 14. The screen 14 is placed, in the preferred case, sufficiently far from the mouth 11A to obtain a dwell time at least in excess of 20 minutes for the chips to move from the level of the mouth 11A to the upper edge of the screen 14. This means in practice that the distance is preferably in excess of 4 meters, preferably in excess of 5 meters, and more preferably in excess of 6 meters. At this first screen girdle 14, such an amount of impregnation liquor is extracted liquor 13 that the desired liquor:wood ratio after addition of white liquor is obtained. In order to fully to minimize the build-up of released material, all this extracted liquor 13 is led off, according to the preferred embodiment shown, to a second flash cyclone, shown at 20, from which the liquor 21 is taken to the recovery. The steam from the second flash cyclone 20 can be used at another point in the system.

After having passed the first screen girdle 14, the chip column continues down and encounters, immediately below this first screen-girdle 14, a first cooking circulation 15. The purpose of the cooking circulation 15 is to increase the temperature of the cooking liquid up to a suitable cooking temperature, i.e. preferably in excess of 150° C., more preferably in excess of approximately 155° C. Preferably, the cooking circulation increases the temperature of the cooking liquor by at least 10° C. In most cases, it is necessary to have at least two such cooking circulations, shown at 15 and 16, in order to achieve, with sufficiently good distribution, the desire temperature in the chip column. The first cooking circulation 15 is placed quite near, i.e. immediately below, the first extraction screen girdle 14. The distance between the lower edge 14 of the extraction screen and the upper edge of the digester screen should be less than 5 meters, more preferably 3 meters, and even more preferably 1.5 meters, in order to attain the desired temperature sufficiently quickly.

The extracted liquor from the digester screen 15 is recirculated by means of a pump, shown at 15A, pumping the cooking liquid through a heat exchanger, shown at 15B, where the desired heating is obtained, and is reintroduced into the digester preferably together with newly added white liquor by means of a central pipe whose mouth 15C opens out approximately level with the actual screen girdle 15. The second cooking circulation, shown at 16, 16A, 16B, and 16C, functions in a corresponding manner to the first cooking circulation. In the preferred case which is shown in the drawing, two digester screens have been used. The chip column and its surrounding liquid have then reached the desired cooking temperature, whereupon it enters a cooking zone 6 and continues to move downwards. After a fairly long distance, corresponding to a dwell time of approximately two hours, the chips have moved down to be level with a second set of extraction screens, which have already been mentioned above. These extraction screens correspond to the sort of extraction screen which is normally always found on a continuous digester. The greater part of this extracted liquor is thus conveyed to the first flash cyclone 18 and is thereafter conveyed onwards to recovery. Below the level of the extraction screens 8A and 8B, the chip column enters a countercurrent cooking zone. The chips here encounter cooking liquid which has been extracted at the lower screen 17, heated in a lower heat exchanger, shown at 17B, and with the aid of a pump, shown at 17A, has been recirculated via a central pipe whose mouth 17C opens out level with the screen 17.

According to a preferred embodiment of the present invention, white liquor can be added in at least two positions, on the one hand at the digester top 3, and on the other hand in the cooking circulation. In the case where there are two cooking circulations, it can be added to the one cooking circulation or to both cooking circulations. It is of course also possible to add white liquor in the lower circulation 17, so that the alkali concentration is increased in the counter-current zone, and approximately the same temperature is expediently maintained in all the cooking zones so that the patented method ITC™ is used.

Wash liquor is added at the lower end 10 of the digester, which wash liquor thus moves in a conventional manner in countercurrent and displaces hot liquor from the fiber material, which permits a subsequent cold blow. The pulp is then fed through a feeding arrangement known per se and is conveyed out through a line for further treatment, shown at 9.

The person skilled in the art will appreciate that the invention is not limited by what has been shown in detail above, but can instead be varied within the scope and spirit of the claimed invention. Thus, for example, it is possible to equip a digester according to the method prescribed above with a further circulation down a the bottom, for example a so-called ITC™ circulation, in order to cook to an even lower kappa number, if so desired. An example of a suitable method is disclosed in published Swedish patent application SE 9203462. An MCC design is also conceivable to the person skilled in the art. In addition, the person skilled in the art will appreciate that a number of modifications can be made within the scope of the invention, such as, for example, the choice of the exact temperatures and alkali concentrations, etc.

Also, instead of pumping hot black liquor directly from the extraction screen 8 to the impregnation zone 5, it is possible to pump the hot black liquor which is collected from the first flash cyclone 18 up to the impregnation zone 5. The temperature of the black liquor is then lower, but the advantage obtained is that the black liquor contains less air, which can be a great advantage in connection with elimination foaming problems in the digester. In addition, it is possible, in certain existing digesters, to use the existing screen arrangement and to lead off only some of the extracted liquor from the upper screen girdle and, in the same way as in a conventional cooking circulation, to recirculate the remainder and a the same time also expediently to heat and add white liquor. It is of course also possible for this last-mentioned principle to be used in connection with the erection of new digesters. A single-vessel steam phase digester can also be used.

We claim:

1. A method for continuously cooking kraft pulp in a digester comprising an impregnation zone and a cooking zone, the method comprising:

feeding chips into an inlet of a digester including a concurrent impregnation zone and a cooking zone;

forcing the chips to flow through the concurrent impregnation zone;

supplying black liquor to the concurrent impregnation zone in an amount such that said black liquor makes up greater than 50% by volume of the total volume of liquid present in the impregnation zone to impregnate the chips;

extracting liquor from a screen girdle downstream of where said black liquor is added to the impregnation zone, in the direction the wood chips flow through the impregnation zone, in an amount greater than 50% by volume of the total volume of liquor present at the location of the screen girdle;

maintaining a liquor:wood ratio in the impregnation zone of greater than 3:1;

forcing the impregnated chips to flow through the cooking zone;

providing at least one cooking liquor circulation in which cooking liquor is extracted from the cooking zone within 5 meters of said screen girdle, heated and returned to the cooking zone to heat the chips;

extracting said black liquor from the digester downstream of the cooking zone and supplying at least a portion of the extracted black liquor to the concurrent impregnation zone; and discharging cooked pulp from said digester.

2. A method according to claim 1, wherein said at least one cooking liquor circulation is located immediately below the screen girdle.

3. A method according to claim 1, wherein said black liquor is supplied to the impregnation zone in an amount such that said black liquor makes greater than 60% by volume of the total amount of liquid present in the impregnation zone.

4. A method according to claim 1, wherein said ratio of liquor:wood in the impregnation zone is at least 4:1.

5. A method according to claim 1, wherein said liquor is extracted in an amount greater than about 70% by volume of the total volume of liquor present at the location of the screen girdle.

6. A method according to claim 1, wherein said liquor is extracted in an amount greater than about 90% by volume of the total volume of liquor present at the location of the screen girdle.

7. A method according to claim 1, wherein the temperature of said extracted black liquor being supplied to the concurrent impregnation zone exceeds 140° C.

8. A method according to claim 1, wherein the temperature of said extracted black liquor being supplied to the concurrent impregnation zone exceeds 150° C.

9. A method according to claim 1, wherein said extracted black liquor is directly circulated to the impregnation zone by using a pump and without flashing.

10. A method according to claim 1, wherein a dwell time of the chips flowing through the impregnation zone is at least 20 minutes.

11. A method according to claim 1, wherein white liquor is added to heated cooking liquor being reintroduced into the cooking zone in said cooking liquor circulation.

12. A method according to claim 1, wherein said black liquor is extracted from the cooking zone within 3 meters of said screen girdle.

13. A method according to claim 1, wherein said black liquor is extracted from the cooking zone within 1.5 meters of said screen girdle.

14. A method according to claim 1, herein said black liquor is heated at least 10° C. in said first cooking liquor circulation.

15. A method according to claim 1, further comprising the step of providing a second cooking liquor circulation in which cooking liquor is extracted from the cooking zone, heated and returned to the cooking zone to heat the chips.

16. A method according to claim 15, wherein said black liquor is heated at least 10° C. in said second cooking liquor circulation.

17. A method for continuously cooking kraft pulp in a digester comprising an impregnation zone and a cooking zone, the method comprising:

feeding chips into an inlet of a digester including a concurrent impregnation zone and a cooking zone;

forcing the chips to flow through the concurrent impregnation zone;

supplying black liquor to the concurrent impregnation zone in an amount such that said black liquor makes up greater than 50% by volume of the total volume of liquid present in the impregnation zone to impregnate the chips;

extracting liquor from a screen girdle downstream of where said black liquor is added to the impregnation zone, in the direction the wood chips flow through the impregnation zone, in an amount greater than 50% by volume of the total volume of liquor present at the location of the screen girdle;

maintaining a liquor:wood ratio in the impregnation zone of greater than 3:1;

forcing the impregnated chips to flow through the cooking zone;

providing a first cooking liquor circulation in which cooking liquor is extracted from the cooking zone within 5 meters of said screen girdle, heated by at least 10° C., and returned to the cooking zone to heat the chips;

providing a second cooking liquor circulation in which cooking liquor is extracted from the cooking zone downstream of said first cooking liquor circulation, heated by at least 10° C., and returned to the cooking zone to heat the chips;

extracting said black liquor from the digester downstream of the cooking zone and supplying at least a portion of the extracted black liquor to the concurrent impregnation zone; and discharging cooked pulp from said digester.

* * * * *